US006349532B1

(12) United States Patent
Naylor

(10) Patent No.: US 6,349,532 B1
(45) Date of Patent: Feb. 26, 2002

(54) METHOD AND APPARATUS FOR PRODUCING TEXTILE YARN, AND YARN PRODUCED THEREBY

(75) Inventor: Geoffrey Naylor, Macclesfield (GB)

(73) Assignee: Rieter Scragg Limited (GB)

( * ) Notice: Subject to any disclaimer, the term of this patent is extended or adjusted under 35 U.S.C. 154(b) by 0 days.

(21) Appl. No.: 09/321,811

(22) Filed: May 28, 1999

(30) Foreign Application Priority Data

Aug. 19, 1998 (GB) ..... 9818043

(51) Int. Cl.[7] ..... D01H 7/92

(52) U.S. Cl. ..... 57/284; 57/244; 57/245; 57/246; 57/247; 57/258; 57/289; 57/351

(58) Field of Search ..... 57/245, 289, 246, 57/247, 244, 351, 284, 285, 258; 28/258

(56) References Cited

U.S. PATENT DOCUMENTS

| | | | | | |
|---|---|---|---|---|---|
| 2,198,648 | A | * | 4/1940 | Wylde et al. | |
| 4,218,869 | A | * | 8/1980 | Newton | 57/245 |
| 4,219,997 | A | * | 9/1980 | Hatcher | 57/908 |
| 6,038,847 | A | * | 3/2000 | Jen | 57/908 |

* cited by examiner

*Primary Examiner*—John J. Calvert
*Assistant Examiner*—Shaun R Hurley
(74) *Attorney, Agent, or Firm*—Renner, Otto, Boisselle & Sklar, LLP

(57) ABSTRACT

A method and apparatus for producing a combined textile yarn comprising two yarn components that are false twisted to different twist levels and then combined to form a combined textile yarn. The yarn components may be twisted in the same or opposing directions, and may be drawn simultaneously with twisting to differing draw ratios before being combined.

20 Claims, 1 Drawing Sheet

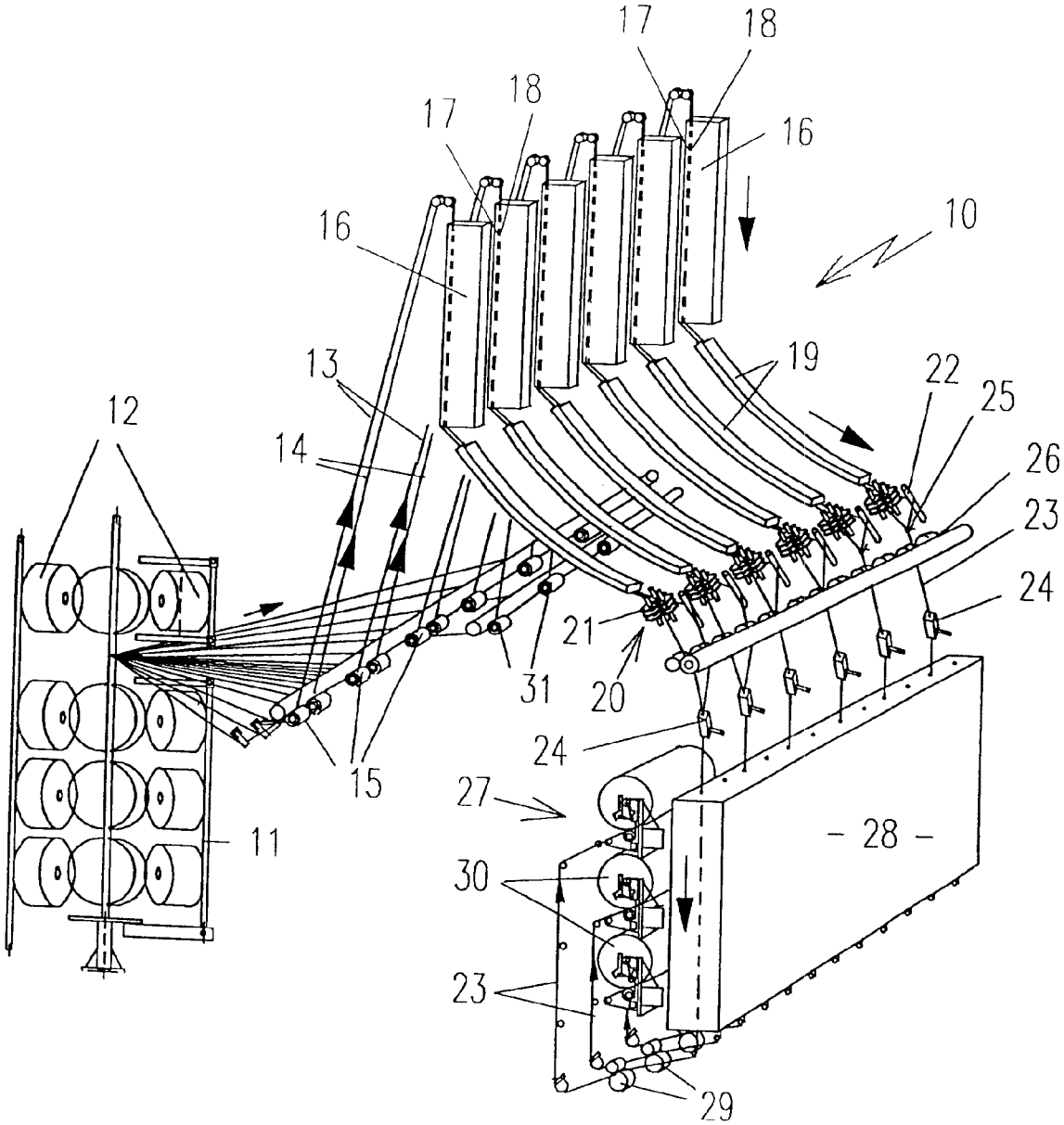
17
18
17
18
16
16
10
13
19
22
25
12
14
26
23
24
21
31
20
24
15
27
11
28
30
23
29

METHOD AND APPARATUS FOR PRODUCING TEXTILE YARN, AND YARN PRODUCED THEREBY

FIELD OF THE INVENTION

This invention relates to a textile yarn and to its method of production.

BACKGROUND OF THE INVENTION

The producers of textile fabrics and garments are continually searching for new and different synthetic yarns from which to manufacture their products in an attempt to more nearly approximate to, or even improve upon, the qualities of such fabrics when made from yarns of natural fibres. The principal objective is for a fabric or garment producer to increase his share of the market in such products by improving the quality of his products and/or reducing the cost of their manufacture. Similarly the yarn producers are continually searching for new and different synthetic or combination yarns in an attempt to sell more of their yarns to the fabric producers. In this constant quest for new and improved yarns, many differing types of yarn and combinations of differing yarns have been devised, but the search for further improvements continues. Some of the types of yarn that have been devised involve a complicated method of production and/or the use of expensive machinery, thereby increasing the cost of the yarns and the fabrics produced from them.

SUMMARY OF THE INVENTION

It is an object of the present invention to provide a novel type of yarn and its method of manufacture which is not inordinately expensive by comparison with known and accepted yarns, but which gives an improved feel and appearance to a fabric manufactured from such a yarn.

The invention provides a combined textile yarn comprising a high false twisted yarn component combined with a low false twisted yarn component. The yarn may comprise a high false twisted yarn component co-mingled with a low false twist yarn component.

The invention also provides a method of producing a textile yarn comprising subjecting a first yarn end to a high false twist, simultaneously subjecting a second yarn end to a low false twist, and then combining the two yarn ends to form a combined textile yarn. The method may comprise friction false twisting both yarn ends, and may comprise feeding the first yarn end in contact with a plurality of overlapping discs distributed around a path of the first yarn end and rotating about axes parallel with that yarn path, whilst feeding the second yarn end in a helical path around the surface of a rotating roller disposed at an angle to the direction of travel of the second yarn end. One yarn end may be twisted in one direction and the other in the opposite direction, i.e. one end S-twist and the other end Z-twist, or both yarn ends may be twisted in the same direction, i.e. both ends S-twist or both ends Z-twist. The two yarn ends may be false twisted at differing D/Y ratios. The two yarn ends may be drawn simultaneously with false twisting, and may be drawn at differing draw ratios. The step of combining of the yarn ends may comprise co-mingling the yarn ends using an air jet. The method may comprise feeding the two false twisted yarn ends together to combine them and then feeding the combined yarn to the air jet, or may comprise feeding the two false twisted yarn ends into the air jet to be combined therein.

In a textile machine having a plurality of yarn texturing positions, the method may comprise feeding the first yarn end of an adjacent pair of yarn ends to a false twist device adapted to subject the first yarn end to a high false twist, feeding the second yarn end of the adjacent pair of yarn ends to a false twist device adapted to subject the second yarn end to a low false twist, and then combining the adjacent pair of false twisted yarn ends to form a combined yarn. The method may comprise feeding the adjacent pair of yarn ends separately through a common heating device prior to feeding them to a respective false twist device.

The invention also provides a textile machine for performing the above method, comprising a creel for the supply of a plurality of yarn ends; for each yarn end, heating means, cooling means and false twist means; and for each adjacent pair of yarn ends, combining means and take-up means for winding the combined yarn onto a package. Preferably the heating means comprises a heating device adapted to receive a pair of adjacent yarn ends to pass therethrough. The heating device may comprise an elongate heated surface having two spaced substantially parallel grooves extending therealong. The false twist means may comprise a first false twist device adapted to subject a first yarn end to a high false twist and a second false twist device adapted to subject a second yarn end to a low false twist. The first false twist device may comprise a plurality of overlapping discs distributed around a path of the first yarn end through the device, and rotating about axes parallel with that yarn path. The second false twist device may comprise a rotating roller disposed at an angle to the direction of feeding the second yarn end, wherein the second yarn end is guided to travel in a helical path around the surface of the roller. One of the false twist devices may be adapted to impart a twist to a yarn end in one direction and the other false twist device may be adapted to impart a twist to the other yarn end in the opposite direction, or both false twist devices may be adapted to impart a twist to the yarn ends in the same direction. The two false twist devices may be driven at differing speeds to provide false twisting the two yarn ends at differing D/Y ratios. Additionally or alternatively the two yarn ends may be fed at differing speeds to and/or drawn at differing speeds from their respective false twist devices. The combining means may comprise an air jet, and may also comprise a combining yarn guide disposed upstream of the air jet.

BRIEF DESCRIPTION OF THE DRAWINGS

The single FIGURE is a schematic illustration of a textile machine for making the textile yarn of the present invention.

DETAILED DESCRIPTION OF THE DRAWINGS

The invention will now be described with reference to the accompanying drawing, in which there is shown a textile machine 10 comprising a creel 11 in which yarn supply packages 12 are mounted. Adjacent first yarn ends 13 and second yarn ends 14 are fed by first feed roller pairs 15 to heating devices 16, the two adjacent yarn ends 13, 14 passing along parallel grooves 17, 18 in the surface of a single heater 16. The yarn ends 13, 14 then pass over cooling tracks 19, each cooling track 19 having two grooves therein to receive the adjacent yarn ends 13, 14. On leaving the cooling track 19, the first yarn end 13 passes to a first false twist device 20 of the type comprising a plurality of overlapping discs 21 distributed around a path of the first yarn end 13 through the false twist device 20 and rotating about axes parallel with that yarn path. This first false twist device 20 is of the type described in GB-A 1419085 and subjects the yarn end 13 to a relatively high false twist. On leaving the cooling track 19, the second yarn end 14 passes to a second false twist device 22 in the form of a rotating roller disposed at an angle to the direction of travel of the second yarn end 14. This second false twist device 22 is of the type described in GB-A 2190106 and the yarn end 14 is guided to pass in a helical path around the surface of the roller 22 to subject the second yarn end 14 to a relatively low false twist. One of the false twist devices 20 may be adapted to impart a twist to a yarn end 13 in one direction and the other false twist device 22 may be adapted to impart a twist to the other yarn end 14 in the opposite direction, i.e. one end S-twist and the other end Z-twist, or both false twist devices 20, 22 may be adapted to impart a twist to the yarn ends 13, 14 in the same direction, i.e. both ends S-twist or both ends Z-twist. In addition, the relative drive speeds of the first and second false twist devices 20,22 may be varied to provide false twisting at different D/Y ratios in the two cases.

The two false twisted yarn ends 13, 14 are fed together to be combined into a single yarn 23. The combining of the yarn ends 13, 14 may occur in an air jet 24 as shown in the drawing at the nearest two combined positions, or at a combining guide 25 upstream of the air jet 24 as shown in the drawing at the farthest two combined positions, or at an intermediate feed roller pair 26 as shown in the drawing at the middle two positions. The air jet 24 has the effect of co-mingling the filaments of the two yarn ends 12, 14 so that a consolidated and stable combined yarn 23 results. The difference in effect caused by either combining the two yarn ends 13, 14 in the air jet 24, at the intermediate feed roller pair 26 or at the combining yarn guide 25 prior to co-mingling in the air jet 24 is one of the degree of co-mingling of the filaments of the two yarn ends 13, 14. Which of the three arrangements is chosen is dependent upon the characteristics of the combined yarn 23 required for any particular application. After leaving the air jet 24, the combined yarn 23 is fed either directly to a take-up zone 27, or through an optional setting heater 28 and a third feed roller pair 29 to the take-up zone 27. Whether the combined yarn 23 is passed through the setting heater 28 or is fed directly to the take-up zone 27 is dependent on the degree of set or twist liveliness respectively required in the resulting combined yarn 23 for any particular application. On reaching the take-up zone 27, the co-mingled combined yarn 23 is wound onto a package 30.

The two yarn ends 13, 14 may be the same as or different from each other, i.e. any combination of polyester, nylon or other yarn. Dependent on the type of supply yarns, the yarn ends 13, 14 may be drawn between the first feed roller pair 15, as shown in the drawing at the nearest three yarn end pair positions, and the intermediate feed roller pair 26. If the supply yarn ends 13, 14 are different and/or in order to produce a different effect in the combined yarn 23, the yarn ends 13, 14 may be drawn by differing amounts by feeding yarn end 13 and yarn end 14 to different first feed roller pairs 15 and 31 respectively (as shown in the drawing at the farthest three yarn end pair positions), and/or in a similar manner to different intermediate feed roller pairs (not shown) instead of to the common feed roller pairs 26 (as shown).

By means of the invention a combined yarn 23 is produced which when knitted into a fabric displays a random thick/thin effect and a random mottled appearance. Such a fabric has a pleasing warm and soft feel and is also pleasing in appearance. The actual qualities of the yarn and fabric made therefrom can be readily varied by the choice of the same or different supply yarn ends, the degree of drawing of those yarn ends, the relative degree of false twisting of the two yarn ends, co-mingling at combining or after combining and absence or degree of setting subsequent to combing. There is therefore, with the method of this invention, a considerable variety of effects that can be produced in a final fabric, at a cost which is comparable with the production of conventional fabrics made from yarns produced by current methods. In consequence such fabrics may be desirable for the production of many differing types of garment, furnishings or the like.

What is claimed is:

1. A method of producing a textile yarn comprising feeding a first yarn end in contact with a plurality of overlapping discs distributed around a path of the first yarn end and rotating about axes parallel with that yarn path, whilst feeding a second yarn end in a helical path around the surface of a rotating roller disposed at an angle to the direction of travel of the second yarn end, simultaneously friction false twisting the two yarn ends to different twist levels, and then combining the two yarn ends to form a combined textile yarn.

2. A method of producing a textile yarn comprising simultaneously false twisting one yarn end in one direction and another yarn end in the opposite direction to different twist levels, and then combining the two yarn ends to form a combined textile yarn.

3. A method of producing a textile yarn comprising simultaneously false twisting two yarn ends in the same direction to different twist levels, and then combining the two yarn ends to form a combined textile yarn.

4. A method of producing a textile yarn comprising simultaneously false twisting two yarn ends at differing D/Y ratios to different twist levels, and then combining the two yarn ends to form a combined textile yarn.

5. A method of producing a textile yarn comprising simultaneously false twisting two yarn ends to different twist levels, drawing the two yarn ends at differing draw ratios simultaneously with false twisting, and then combining the two yarn ends to form a combined textile yarn.

6. A method of producing a textile yarn in a textile machine having a plurality of yarn texturing positions, comprising feeding a first yarn end of an adjacent pair of first and second yarn ends to a false twist device adapted to subject the first yarn end to a higher false twist than the second yarn end, feeding the second yarn end of the adjacent pair of yarn ends to a false twist device adapted to subject the second yarn end to a lower false twist than the first yarn end, simultaneously false twisting the adjacent pair of yarn ends to different twist levels, and then combining the adjacent pair of false twisted yarn ends to form a combined textile yarn.

7. A method of producing a textile yarn according to claim 6, comprising feeding the adjacent pair of yarn ends separately through a common heating device prior to feeding the yarn ends to the respective false twist devices.

8. A textile machine for performing a method of producing a textile yarn by simultaneously false twisting two yarn ends to different twist levels and then combining the two yarn ends to form a combined textile yarn, comprising a creel for the supply of a plurality of yarn ends; for each yarn end, heating means, cooling means and false twist means; and for each adjacent pair of yarn ends, combining means and take-up means for winding the combined yarn onto a package.

9. A textile machine according to claim 8, wherein the heating means comprises a heating device adapted to receive a pair of adjacent yarn ends to pass therethrough.

10. A textile machine according to claim 9, wherein the heating device comprises an elongate heated surface having two spaced substantially parallel grooves extending therealong.

11. A textile machine according to claim 8, wherein the false twist means comprises a first false twist device adapted to subject a first yarn end to a higher false twist than a second yarn end and a second false twist device adapted to subject the second yarn end to a lower false twist than the first yarn end.

12. A textile machine according to claim 11, wherein the first false twist device comprises a plurality of overlapping discs distributed around a path of the first yarn end through the device, and rotating about axes parallel with that yarn path.

13. A textile machine according to claim 11, wherein the second false twist device comprises a rotating roller disposed at an angle to the direction of feeding the second yarn end, wherein the second yarn end is guided to travel in a helical path around the surface of the roller.

14. A textile machine according to claim 11, wherein one of the false twist devices is adapted to impart a twist to a yarn end in one direction and the other false twist device is adapted to impart a twist to the other yarn end in the opposite direction.

15. A textile machine according to claim 11, wherein both false twist devices are adapted to impart a twist to the yarn ends in the same direction.

16. A textile machine according to claim 11, wherein the two false twist devices are driven at differing speeds to provide false twisting the two yarn ends at differing D/Y ratios.

17. A textile machine according to claim 11, wherein the two yarn ends are fed at differing speeds to their respective false twist devices.

18. A textile machine according to claim 11, wherein the two yarn ends are drawn at differing speeds from their respective false twist devices.

19. A textile machine according to claim 8, wherein the combining means comprises an air jet.

20. A textile machine according to claim 19, wherein the combining means comprises a combining yarn guide disposed upstream of the air jet.

* * * * *